US005766828A

United States Patent [19]

Patel et al.

[11] Patent Number: 5,766,828

[45] Date of Patent: Jun. 16, 1998

[54] LASER ADDRESSABLE IMAGING ELEMENTS

[75] Inventors: Ranjana C. Patel, Little Hallingbury; Jonathan C. Vogel, Harlow, both of Great Britain

[73] Assignee: Imation Corp.

[21] Appl. No.: 709,966

[22] Filed: Sep. 9, 1996

[30] Foreign Application Priority Data

Sep. 19, 1995 [GB] United Kingdom ..... 9519163

[51] Int. Cl.[6] ..... G03C 1/498

[52] U.S. Cl. ..... 430/350; 430/512; 430/517; 430/619; 430/944

[58] Field of Search ..... 430/350, 617, 430/619, 517, 512, 944

[56] References Cited

U.S. PATENT DOCUMENTS

| | | | |
|---|---|---|---|
| 5,041,369 | 8/1991 | Fukui et al. . | |
| 5,196,297 | 3/1993 | Dombrowski, Jr. et al. . | |
| 5,260,180 | 11/1993 | Sahyun et al. . | |
| 5,360,694 | 11/1994 | Thien et al. | 430/200 |
| 5,380,644 | 1/1995 | Yonkoski et al. | 430/619 |

FOREIGN PATENT DOCUMENTS

| | | |
|---|---|---|
| 0582144 | 2/1994 | European Pat. Off. . |
| 0599369 | 6/1994 | European Pat. Off. . |
| 0599463 | 6/1994 | European Pat. Off. . |
| 0674217 | 9/1995 | European Pat. Off. . |
| WO95/07822 | 3/1995 | WIPO . |
| WO 96/10213 | 4/1996 | WIPO . |

*Primary Examiner*—Thorl Chea

[57] ABSTRACT

An infrared laser addressable imaging element comprising a substrate bearing a first layer comprising a reducible light-insensitive silver salt and a binder; and a second layer comprising an infrared absorber, a reducing agent for said silver salt and a binder; wherein said binder of said first layer is a polymeric medium having a glass transition temperature of at least 80° C.

25 Claims, 2 Drawing Sheets

LASER ADDRESSABLE IMAGING ELEMENTS

FIELD OF THE INVENTION

The invention relates to IR laser addressable imaging elements which provide monochrome images in response to laser exposure, either directly or after thermal processing, and can provide both halftone and continuous tone images.

BACKGROUND TO THE INVENTION

There is continuing interest in monochrome image-forming media suitable for address by lasers, particularly media requiring no processing subsequent to the laser exposure ('direct write' media), or requiring only uniform thermal processing to develop the image. Such media do not generate waste materials (e.g., in the form of processing solutions, used donor sheets, strippable cover sheets, and the like) which may present a disposal problem, and are the most convenient media from the user's point of view.

Two main areas of utility for such monochrome image-forming media are graphic arts films and medical imaging films and papers, which generally impose differing requirements on the imaging media. Graphic arts films are normally used to provide a contact mask for subsequent UV flood-exposure of a printing plate or proofing element. For this reason, they should have a high contrast, strong absorption in the UV in image areas, and high UV transparency in the background areas. The visual appearance (tone) of the graphic arts image is less important. On the other hand, medical imaging media are used to record on film or paper the output of digital radiography equipment, CAT scanners, magnetic resonance scanners, ultrasound scanners etc. To facilitate inspection and interpretation of the images by the human eye, continuous tone images with a neutral black appearance are required, preferably with a high Dmax capability (e.g., greater than 3.0).

In view of these contradictory requirements, different types of imaging media have been proposed for the different applications. For example, the high contrast requirements of graphic arts media are most easily met by methods such as mass transfer, ablation transfer or peel-apart systems, as described in U.S. Pat. Nos. 3,962,513, 5,171,650, 5,352,562, 4,981,765 and 5,262,275, EP-A-0465727 and EP-A-0488530, and International Patent Applications Nos. WO90/12342, WO93/04411, WO93/03928 and WO88/04237. Such methods generally involve the disposal of at least one donor sheet or cover sheet, and are inherently incapable of continuous tone imaging.

Continuous tone imaging requires that image density be produced in proportion to the exposure energy received. Systems which meet this requirement include dye diffusion (or sublimation) transfer, and systems described in U.S. Pat. Nos. 4,826,976, 4,720,449, 4,960,901, 4,745,046, 4,602,263 and 4,720,450 wherein dyes (yellow, magenta or cyan) are created or destroyed in response to heat generated by laser exposure. These systems do not easily produce a neutral black colour or a high Dmax. Consequently, for medical imaging the main emphasis has been on systems involving the reduction of metal salts, especially silver salts, to the corresponding free metal.

Silver-based imaging elements that can be imagewise exposed by means of light or heat are well known. Silver halide conventional photographic and photothermographic elements are the most representative elements of the class of light-sensitive materials. In both conventional photographic ('wet silver') and photothermographic ('dry silver') elements, exposure of the silver halide in the photosensitive emulsion to light produces small clusters of silver atoms ($Ag^{\circ}$). The imagewise distribution of these clusters is known in the art as a latent image. Generally, the latent image formed is not visible by ordinary means and the photosensitive emulsion must be further processed to produce a visible image. In both dry and wet silver systems the visible image is produced by the reduction of silver ions which are in catalytic proximity to silver halide grains bearing the clusters of silver atoms, i.e., the latent image. This produces a black and white image.

Conventional photographic silver halide elements require a wet development process to render the latent image visible. The wet chemistry used in this process requires special handling and disposal of the spent chemistry. The process equipment is large and requires special plumbing.

In photothermographic elements, the photographic silver halide is in catalytic proximity to a non-photosensitive, reducible silver source (e.g., silver behenate) so that when silver nuclei are generated by light exposure of the silver halide, those nuclei are able to catalyze the reduction of the reducible silver source. The latent image is amplified and rendered visible by application of uniform heat across the element.

U.S. Pat. No. 5,041,369 describes a process which capitalizes on the advantage of a dry processed photothermographic element without the need for surface contact with a heating device. The photothermographic element is imagewise exposed with a laser which splits the beam using a second harmonic generation device. In this process, the element is simultaneously exposed with one wavelength of light and thermally activated by the second wavelength of light. Even though this process has the advantage of simultaneous exposure and heat development of the image, the equipment is complex and limited by laser outputs capable of generating two useful separate wavelengths.

Photosensitive emulsions which contain silver halide are well known in the art to be capable of causing high minimum density (Dmin) in both the visible and ultraviolet (UV) portions of the spectrum. The high UV Dmin is due to the inherent absorption in the near UV of silver halides, particularly silver bromide and silver iodide, and to high haze when silver halide and organic silver salts are present together. High UV Dmin is undesirable for graphic arts scanner and imagesetting films since it increases the exposure time required during contact exposure with other media such as UV printing plates, proofing films etc. High haze can also lead to loss of image resolution when imaged photothermographic elements are used as contact films. It is also well known that imaged photothermographic elements comprising silver halides are prone to unwanted build up of Dmin in the background areas, especially on prolonged exposure to light.

Closely related to the above-described photothermographic media are the materials described in U.S. Pat. No. 5,260,180, which discloses thermally imageable compositions comprising a silver salt of an organic acid, a reducing agent, and, optionally, an activator, coated together in a suitable binder, which can be rendered photoimageable by the addition of a tetrahydrocarbylborate salt. The compositions develop a black silver image when subjected to imagewise light exposure and uniform thermal development. It is believed that a portion of the silver salt is converted to the silver tetrahydrocarbylborate, which forms catalytic $Ag^{\circ}$ clusters in response to light exposure. When a suitable sensitising dye is present, a laser may be used for the imagewise exposure.

Thermographic elements are a class of imaging elements that do not rely on silver halide based chemistry. They are commonly used in labels, tickets, charts for recording the output of medical or scientific monitoring apparatus, facsimile paper, and the like. In their most common form, thermographic elements comprise a support carrying a coating of a thermally-sensitive composition comprising a colour former and a developer which react together to generate image density on application of heat. Examples of colour formers include leuco dyes which may be oxidised to the corresponding coloured dyes by suitable developing agents. Mixtures of leuco dyes may give rise to a black image, but an alternative route to a black image is the thermal reduction (to the free metal) of a light-insensitive metal salt of an organic acid (especially a silver salt such as silver behenate) by means of a suitable reducing agent.

Conventionally, heat has been applied imagewise to thermographic elements by thermal print heads, thermal styli and the like. However, in recent years such materials have been adapted for laser address by incorporating in the thermosensitive coating one or more infrared (IR) absorbers. These compounds can absorb the output of IR lasers and thus generate heat in irradiated areas which triggers the thermographic chemistry. For example, U.S. Pat. No. 5,196,297 discloses recording materials which employ colour-forming di- and tri-arylmethane compounds possessing certain S-containing ring-closing moieties and a Lewis acid material capable of opening said moieties. The preferred Lewis acid is a silver salt such as silver behenate, which converts the colour-forming compounds to their coloured form under the action of heat. In some embodiments, the heat is supplied via absorption of laser radiation by an IR dye.

In the field of black and white imaging, EP-A-0,582,144 discloses a thermal recording material comprising a substrate coated with an imaging system, the imaging system containing (a) a thermally reducible source of silver, (b) a reducing agent for silver ion, (c) a dye which absorbs in the range 500–1100 nm, and (d) a polymeric binder. The material gives a black image in response to laser address without need for further processing, but the scan rates and dwell times quoted are impractibly slow, e.g., 15 cm/sec and tens or hundreds of milliseconds respectively. Similarly, EP-A-0,599,369 discloses a recording material comprising a support and at least one imaging layer containing uniformly dispersed in a polymeric binder (1) a substantially light-insensitive silver salt in working relationship with (2) at least one organic reducing agent, characterised in that said organic reducing agent is a polyhydroxy spiro-bis-indane. In some embodiments, an IR absorber is also present and imaging is by laser address, but in the example given, a Dmax of only 0.47 was obtained and the writing time for an A3-sized image was 24 minutes. The imaging materials disclosed in both these patents are of the direct-write type, in which the image density is generated at the moment of laser exposure, and there is no capability for amplification via post-exposure processing.

EP-A-0,582,144 discloses placement of reducing agent in the same layer as the silver salt, whereas EP-A-0,599,369 discloses that placement of reducing agent in a separate layer is also possible, although no advantage is cited for this configuration, and indeed the Examples disclose only single-layer constructions. This accords with conventional wisdom regarding direct-write media imageable by laser address, where the generation of an adequate image density at a realistic scan rate is seen as the major problem to be overcome. Requiring the reducing agent to migrate from one layer to another before imaging can take place would be expected to increase the energy demand, and hence lower the writing speed.

WO95/07822 discloses imaging materials broadly similar to those of EP-A-0,599,369, except that additional restrictions are placed on the absorption spectrum of the IR absorber (in the interests of improved UV and visible transparency), and a wider range of reducing agents are described.

None of EP-A-0,582,144, EP-A-0,599,369 and WO95/07822 teaches any particular importance for the selection of the binders used, and all three recite a wide variety of polymers as being suitable. However, in the Examples of all these publications, polyvinyl butyral) is the only binder material disclosed for the silver-containing layers. Poly (vinyl butyral) has a glass transition temperature (Tg) of about 50°–56° C.

BRIEF SUMMARY OF THE INVENTION

In accordance with the present invention, there is provided an IR laser addressable imaging element comprising: a substrate; a first layer comprising a reducible light-insensitive silver salt and a binder; and a second layer comprising an infrared absorber, a reducing agent for said silver salt and a binder; characterised in that the binder of said first layer is a polymeric medium having a glass transition temperature of at least 80° C.

Imaging elements in accordance with the invention are of the single sheet type, in which a single support sheet carries all the component layers. Apart from an optional heat treatment, no processing steps (such as wet development, peeling apart etc.) are required subsequent to laser imaging for the purposes of developing or fixing the image.

It is now surprisingly found that two-layer direct-write media are indeed capable of high sensitivity, and that the two-layer configuration enables post-exposure thermal amplification of the image (which further enhances the sensitivity) and continuous tone imaging, neither of which is described in the prior art. Furthermore, the performance improves with increasing binder Tg which is contrary to expectations.

The invention further extends to imaging methods employing such elements, comprising the steps of:

1) image-wise irradiating the element with IR laser radiation of sufficient intensity so as to generate a latent image of silver specks having a $D_{max}$ of less than 1.0, and 2) heating the element to produce a visible image having a $D_{max}$ of at least 2.5.

Imaging elements in accordance with the invention produce a monochrome silver metal image in response to laser irradiation, either directly or after uniform thermal processing. By control of the exposure and processing conditions, the media may provide either a high-contrast image suitable for graphic arts applications, or a continuous tone image suitable for medical imaging applications. Imaging speed and Dmax are greatly improved in comparison with prior art materials.

The imaging elements of the invention resemble laser-addressable thermographic elements of the prior art in that they comprise a substrate, a non-photosensitive silver salt, a reducing agent (i.e., developer for silver ion) and an IR absorber, but are distinguished from the elements of the prior art by the placement in separate layers of the reducible silver salt and the reducing agent, and by the nature of the binder used in the layer comprising the reducible silver salt. Prior art publications disclose the placement of the silver salt and the reducing agent in the same layer, with the IR absorber optionally in a separate layer. The layer configuration of the present invention not only provides improved pre- and post-imaging stability (ensuring a low Dmin), but is also believed to facilitate imaging in continuous tone and to enable post-exposure thermal amplification of the initial image, neither of which are described in the prior art.

Furthermore, the prior art shows a strong bias toward the use of poly(vinyl butyral) as the binder for the layer containing the silver salt. This reflects the status of poly(vinyl butyral) as the binder of choice for the corresponding layer in conventional photothermographic media of the dry silver type (i.e., comprising light-sensitive silver halide, or a similar species, as photocatalyst in reactive association with a light-insensitive reducible silver salt). The preference for poly(vinyl butyral) in this context results, at least partly, from its favourable Tg of about 50°–56° C. This is high enough to restrict unwanted diffusion and mixing of ingredients at ambient and moderately elevated temperatures, but is also low enough to permit rapid diffusion and mixing under normal development conditions (about 100°–150° C.). It is now surprisingly found that in the laser addressable thermographic elements of the present invention, higher sensitivity and Dmax are obtained through the use, as binder for the layer containing the reducible silver salt, of a polymeric medium having a Tg greatly in excess of 50° C., i.e., at least 80° C., preferably at least 100° C., and more preferably at least 120° C., which temperature being (in most cases) greater than the temperature at which post-exposure thermal processing is carried out to amplify the image.

Without seeking to limit the scope of the invention in any way, the following explanation is proposed for the surprising trend observed. The primary image-forming event is the absorption of a pulse of laser radiation in the layer containing the IR absorber. Depending on the intensity of the laser radiation and the optical density provided by the IR absorber, extremely high temperatures may be generated briefly in the exposed areas, sufficient to cause melting or even decomposition of the binder(s) of both layers, at least in the region of the interface of the layers, effectively disrupting said interface and enabling at least partial mixing of the ingredients of the respective layers. Hence, the silver salt and reducing agent may interact during laser exposure, the former being reduced by the latter to form a metallic silver image in exposed areas. If the laser pulse is sufficiently intense and/or of long enough duration, the resulting image density may be sufficient for final viewing, i.e., a "direct write" or print-out image is obtained. On the other hand, if the laser pulse is shorter or less intense, the initial image may be too faint or may even be invisible to the naked eye. Nevertheless, the disrupted interface represents an area of enhanced diffusibility, in which further interaction between silver salt and reducing agent can be stimulated by post-exposure thermal processing, which thus provides an amplification of the initial image.

In this model, it is assumed that the energy absorbed via the laser exposure is sufficient to create a "zone of disruption" irrespective of the Tg of the binder(s) involved. The effect of raising the Tg of the binder of the layer containing the silver salt would be to enable more sharply-defined zones of disruption to be formed. Within said zones, relatively free diffusion of the reducing agent is possible during post-exposure thermal processing, and essentially all of the silver salt within said zones is available for reduction to silver metal, but outside said zones, diffusion of the reducing agent is inhibited by the high Tg of the binder. Thus, by careful control of the post-exposure thermal processing, it is possible to reduce all of the silver salt within a zone of disruption while essentially no reduction takes place in adjacent zones. Since the size (and, in particular, the depth) of the zone of disruption is directly related to the amount of laser energy absorbed, genuine continuous tone imaging is possible. In other words, within a given exposed area, the proportion of the available silver salt that is actually reduced to silver metal relates directly to the intensity of exposure received. This degree of control is not available when low Tg binders such as polylvinyl butyral) are used for the layer containing the silver salt.

While the above mechanism accords with many of the observed properties of the imaging elements of the invention, additional or alternative mechanisms are not precluded.

DESCRIPTION OF PREFERRED EMBODIMENTS

Binders

Figure 1:
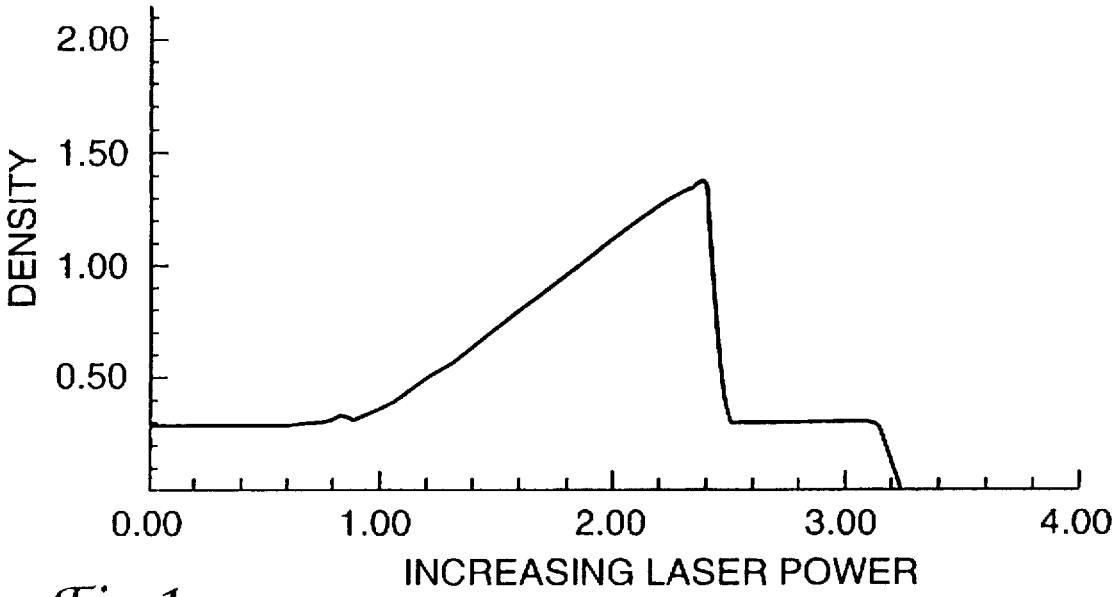

The binder of the first layer, comprising the silver salt, must have a Tg of at least 80, preferably at least 100, and more preferably at least 120° C. As is well known by those skilled in the art, precise measurement of Tg is not always possible. Factors which lead to variability in published and measured values for a given polymer include the thermal history of the sample, structural variables such as tacticity, and the method of measurement itself (e.g., differential scanning calorimetry, dynamic thermal-mechanical analysis etc.). For a given polymer, the presence of moisture or low molecular weight impurities may lower the measured value, while crosslinking may raise it. For the purposes of the present invention, quoted Tg values are for 'pure' (unadulterated) polymers, copolymers or blends. Although absolute values of Tg may be treated with some caution, differences in Tg for different polymer samples, measured by the same method, are entirely reliable, and the trend observed in the present invention (that sensitivity and other attributes improve with increasing binder Tg) is unaffected by the aforegoing caveat.

In addition to fulfilling the Tg requirements, the binder of the layer comprising the silver salt should preferably be transparent throughout the visible and near infrared spectrum. Other desirable attributes include good film-forming properties, compatibility with the silver salt and other ingredients of the layer, solubility in common organic solvents (such as lower alcohols, ketones, ethers and hydrocarbons), and resistance to yellowing on prolonged light exposure. A wide variety of polymeric materials may satisfy these criteria, including polymers and copolymers of acrylic and methacrylic acids (and ester, amide and nitrile derivatives thereof), maleic anhydride, and vinyl monomers such as styrenes, 1-alkenes, vinyl halides, vinyl ethers and vinyl esters. Other suitable polymer classes include polyesters, polycarbonates, and cellulose esters.

Blends of two or more different polymers may be used. Preferred binder materials include polymers and copolymers of methacrylate esters, styrene-maleic anhydride copolymers, and cellulose acetate butyrate.

Polymers which are capable of at least partial decomposition under the conditions of laser exposure may confer additional benefits when used as the binder material. However, such decomposition should not be so catastrophic as to cause ablation of the imaging medium. It is believed that decomposition of the binder during laser exposure enhances the diffusibility of the reducing agent in exposed areas during subsequent thermal processing. It is also possible that polar groups such as carboxylic acid, formed as a result of the decomposition, influence the morphology of the silver metal image, and hence improve its tone and covering power. Binder materials which are believed to behave in this fashion include styrene-maleic anhydride copolymers, and reactive polymers comprising a backbone linked to a plurality of pendant groups, said pendant groups being convertible to polar species under the action of heat or acid, or both. Preferably said pendant groups are neutral, relatively nonpolar species, such as ester groups, which can decompose thermally to form the corresponding carboxylic acids which are relatively polar species.

Suitable pendant groups include t-alkyl esters such as t-butyl esters (as disclosed in EP-A-0,249,139), benzyl esters such as nitrobenzyl and cyanobenzyl esters (as disclosed in U.S. Pat. No. 4,963,463), alkoxyalkyl esters such as methoxymethyl esters (as disclosed in WO92/09934), and cyclic acetal esters such as tetrahydropyran-2-yl esters (as disclosed in WO92/09934). The cyclic acetal esters are preferred. All these groups are capable of thermal decomposition to the corresponding carboxylic acid, the process being accelerated by the presence of strong Bronsted acids. The resulting change in polarity has been exploited in areas such as photoresists and lithographic printing, but the relevant materials have not hitherto been incorporated in thermographic or photothermographic media. Preferred reactive polymers suitable for use in the invention are polymers or copolymers of tetrahydropyranyl methacrylate (THPM), and comprise repeat units of the following formula:

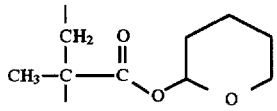

The cyclic acetal ester groups in the units of the above formula are relatively hydrophobic and are stable at ambient temperatures under neutral or alkaline conditions. At elevated temperatures, a cleavage reaction is believed to take place, generating the corresponding carboxylic acid which is polar and hydrophilic, the process being greatly accelerated by the presence of acid:

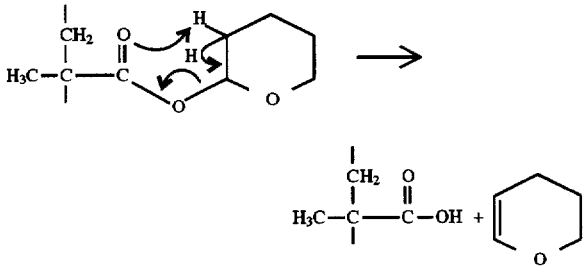

A reactive polymer may additionally comprise repeating units derived from one or more comonomers that do not contain heat- or acid-sensitive groups. For example, THPM (or a similar monomer) may be copolymerised with any of the conventional acrylate, methacrylate or other vinyl monomers to produce polymers with varying physical properties, provided said comonomers do not contain strongly acidic groups (such as carboxylic acid, sulphonic acid etc.) which might cause premature cleavage of the reactive groups, or strongly basic groups (such as amino groups) which might scavenge any acid catalyst generated in the imaging process, and provided the resulting copolymer has a Tg of at least 80° C. Suitable comonomers include vinyl-functional trialkoxysilanes, such as methacryloyloxypropyltrimethoxysilane (MPTS), in quantities of up to 50 mol % of the total monomer content. However, a preferred reactive polymer is a homopolymer of THPM, whose synthesis and polymerisation is disclosed in WO92/09934.

The choice of binder for the second layer, comprising the IR absorber and reducing agent, is not critical, the important criteria being transparency, light stability, film-forming ability, and the ability to dissolve or disperse the IR absorber and reducing agent efficiently. The binder of the second layer is typically selected from the same range of polymers as the binder of the first layer, and most conveniently the same binder is used in both layers, although this is not essential.

Other Ingredients

The other essential ingredients of the imaging elements of the invention, namely the substrate, light-insensitive silver salt, reducing agent and IR absorber, may be selected from the materials used for similar purposes in thermographic and photothermographic media of the prior art. However, it is important to note that this system is substantially free of any effective amount of silver halide. That is, there is less than 0.25% silver halide as compared to reducible silver sources, and preferably less than 0.1% silver halide, more preferably the element is free from silver halide.

Essentially any base or substrate material may be used, provided it has sufficient stability to withstand thermal processing (e.g., for about 30 seconds at 120° C.) without decomposing or distorting. Depending on the end use, transparent, translucent or opaque materials may be used, such as paper and plastic films. Transparent polyester film of thickness 20–200 μm (colourless or blue-tinted) is a preferred substrate. Conventional treatments, such as corona treatment, and/or subbing layers may optionally be applied to the substrate to modify its adhesion or wettability properties towards subsequently-applied coatings.

Light-insensitive silver salts are materials which, in the presence of a reducing agent, undergo reduction to silver metal at elevated temperatures, typically in the range 60°–225° C. Preferably, these materials are silver salts of long chain alkanoic acids (also known as long chain aliphatic carboxylic acids or fatty acids) containing 10 to 30 carbon atoms; more preferably 10 to 28 carbon atoms, and most preferably 10 to 22 carbon atoms. These salts are also known as 'silver soaps'.

Non-limiting examples of silver soaps include silver behenate, silver stearate, silver oleate, silver erucate, silver laurate, silver caproate, silver myristate, silver palmitate, silver maleate, silver fumarate, silver tartarate, silver linoleate, silver camphorate, and mixtures thereof.

The preferred light-insensitive silver salt for use in the invention is silver behenate.

It should be emphasised that the presence of silver salts which are intrinsically light-sensitive, such as silver halides and silver organoborates, is not required or even desirable. Likewise, the presence of compounds capable of reacting with the light-insensitive silver salt to form silver halides or silver organoborates is not preferred. Systems free of light sensitive silver salts such as silver halides and silver organoborates are therefore preferred.

A wide variety of reducing agents for silver ion can be used in the invention, including mixtures of reducing agents, such materials being well-known to those skilled in the art. Examples include, but are not limited to, esters of gallic acid (such as methyl gallate, butyl gallate etc), hindered phenols (such as 2,2'-alkylidenebisphenols), polyhydroxybenzenes (such as hydroquinone, catechol, etc.), ascorbic acid, 1,4-dihydropyridines (such as 3,5-dialkoxycarbonyl-2,6-dialkyl-1,4-dihydropyridines) and the like. Preferred reducing agents for use in the invention are methyl gallate, propyl gallate, 2,2'-methylenebis(4-methyl-6-t-butylphenol), and mixtures thereof.

Imaging elements in accordance with the invention further comprise an IR absorber. Preferred IR absorbers are dyes or pigments absorbing strongly in the range 700–1200 nm, preferably 750–1100 nm, but having minimal absorption in the range 380–700 nm (i.e., the near UV and visible region). Any of the dye classes commonly used in laser-addressable thermal imaging media may be suitable for use in the present invention, such as cyanines, merocyanines, amine cation radical dyes, squarylium dyes, croconium dyes, tetra-arylpolymethine dyes, oxonols etc. Factors affecting the choice of dye include thermal stability, light-fastness, compatibility with other ingredients, and solubility in suitable coating solvents. Preferred classes of IR dye include squarylium, croconium, amine cation radical, and tetraarylpolymethine. Particularly preferred dyes are of the type disclosed in U.S. Pat. No. 5,360,694, which have a nucleus of the following formula:

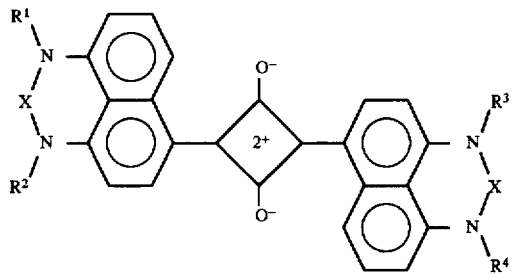

wherein $R^1$ to $R^4$ are independently members selected from the group consisting of hydrogen, alkyl, cycloalkyl, aralkyl, carboalkoxyalkyl and carboaryloxyalkyl group, X is a member selected from the group consisting of $>CR^5R^6$, $>POR^7$ and $>BOR^7$, wherein $R^5$ and $R^6$ are independently members selected from the group consisting of alkyl, cycloalkyl and aryl groups, or $R^5$ and $R^6$ together represents the necessary atoms to complete a 5, 6 or 7-membered ring, and $R^7$ represents an alkyl group.

In preferred embodiments, imaging elements in accordance with the invention further comprise a toner, which is preferably coated in the same layer as the silver salt. Toners are well known in the field of thermographic and photothermographic materials, and are believed to accelerate the reduction of silver salts to silver metal by the appropriate reducing agents, and may also influence the morphology of the silver metal formed, and hence the colour (tone) of the image. The latter effect appears to predominate in the context of the present invention. In the absence of a toner, the image formed may be brown in appearance, and characterised by a relatively sharp, intense peak in the absorption spectrum at about 420 nm. In the presence of toner, this becomes a broader, less intense peak, and the image is blacker in appearance. Any of the compounds or mixtures of compounds known to act as toners may be used in the invention, lists of such compounds being published, for example, in Research Disclosure No. 17029 and U.S. Pat. Nos. 3,080,254, 3,847,612 and 4,123,282. However, the preferred toners are phthalazine (with or without organic acids such as phthalic acid present) and phthalazinone, or substituted derivatives thereof.

Optionally, the imaging elements of the invention may further comprise a secondary or tertiary benzylic alcohol such as benzhydrol or benzpinacol, which may further improve the image tone and/or the sensitivity. Other optional ingredients include surfactants, wetting agents and other coating aids, the use of which is well known to those skilled in the art.

Construction

Imaging elements in accordance with the invention comprise an imaging medium of at least two layers on a substrate.

The Imaging media of the invention may be coated by any of the standard methods, such as slot coating, roller coating, knife coating, or coating via wire-wound bars. The solvents used to dissolve or disperse the various ingredients are typically the commonly used organic solvents such as lower alcohols (methanol, ethanol etc.), lower ketones (acetone, 2-butanone etc.), hydrocarbons (toluene, cyclohexane etc.), ethers and the like. Mixtures of different solvents may be used. The coatings may be dried at ambient temperature or at moderately elevated temperatures, e.g., up to 80° C.

Alternatively, one or more of the layers may be coated on a temporary carrier sheet and transferred to the final substrate by lamination, followed by peeling of the carrier sheet.

A preferred construction comprises a first layer (nearest the substrate) containing the silver salt, the toner (if present), the secondary or tertiary benzylic alcohol (if present), and binder; and a second (upper) layer comprising the reducing agent, the IR absorber and binder. Optionally, the layer order may be reversed, but this is not preferred.

In the multilayer imaging media, reduction of the silver salt occurs primarily at the interface between layers, and so a greater Dmax may be obtainable from a given amount of silver salt if said salt is provided in two or more layers alternating with layers comprising the reducing agent. However, this complicates the coating process, and in practice an adequate Dmax is obtainable from a two-layer coating.

A protective topcoat is preferably applied, but is not essential. Suitable materials are tough, scratch-resistant transparent polymers such as polycarbonates and polyesters, applied as a thin layer (less than 3 mm dry thickness) by conventional solvent coating techniques.

The coating weights of the various ingredients may vary considerably, depending on the identities of the actual compounds chosen, and the intended application. For example, if the application demands a high Dmax, correspondingly high loadings of silver salt will be necessary. In the preferred construction described above, the first layer is typically coated as a dispersion of about 10–20wt % solids at a wet thickness of 36 μm, the silver salt (as the behenate) constituting about 10–90 wt % (preferably from 20–80 wt %) of the total solids. By varying the ratio of silver salt to binder, it is possible to alter the contrast capabilities of the imaging medium. High salt-to-binder weight ratios (e.g., >3:1) lead to high contrast images, whereas lower ratios can give low contrast continuous tone images.

The secondary or tertiary benzylic alcohol (if used) is typically present in approximately equimolar amounts with the silver salt. The toner (if used) may be present in widely-varying amounts (e.g., from 1–150 mole % of the silver salt). The higher concentrations of toner are useful when a less reactive reducing agent (such as a hindered bisphenol) is used. When "active" reducing agents (such as gallate esters) are used, the preferred loading of toner is in the range 1–15 mole % of the silver salt, typically about 5 mole %.

The second layer (comprising reducing agent and IR absorber) is typically coated as a thinner layer, and (for maximum sensitivity) is preferably made as thin as possible for a given loading of reducing agent and IR absorber. However, it is again possible to reduce the contrast of the imaging medium by increasing the binder content over and above the minimum required to form a cohesive layer, at the expense of lowering the sensitivity. The coating weight of the reducing agent is preferably sufficient to provide at least a molar equivalent (but preferably an excess) of reducing agent over silver salt in a given area of coating. The coating weight of the IR absorber depends on the properties of the particular dye or pigment chosen (solubility, extinction coefficient etc.), but is preferably sufficient to provide an optical density (OD) of at least 0.5, preferably at least 1.0, at the intended exposure wavelength. In preferred embodiments (comprising gallate esters as reducing agent and Dye I as the IR absorber), the second layer is coated at 12 μm wet thickness as a solution of about 3–10 wt % solids, the reducing agent constituting at least 25 wt %, preferably at least 50 wt %, of the total solids i.e., the dry weight of the layer. In these constructions, either or both layers may contain minor amounts of surfactants, wetting agents or other coating additives, in accordance with well-known techniques, but the bulk of the remaining solids is accounted for by binder.

It will be apparent from the above description that the imaging elements of the invention are clearly distinguishable from conventional IR-sensitised photothermographic elements of the dry silver type. The latter rely on the presence of a light-sensitive silver halide photocatalyst, which is not required or indeed desirable in the elements of the invention, and furthermore the optical density provided by the sensitising dyes of conventional IR-sensitised photothermographic elements is typically less than 0.3 at the exposure wavelength. Finally, the placement of IR absorber and silver salt in separate layers, as taught in the present invention, is contrary to the normal practice in conventional photothermography.

Method of Use

Imaging elements in accordance with the invention are adapted for address by scanned lasers emitting in the infrared. Essentially any laser device emitting in the range 700–1200 nm (preferably 750–1050 nm) may be used, but diode lasers are preferred for reasons of cost, compactness and reliability. High power versions, capable of delivering at least 100 mW, are preferred as they enable shorter scan times. Any of the known scanning methods may be employed, such as flat-bed scanning, internal drum scanning and external drum scanning. Two or more lasers may scan separate areas of an imaging element simultaneously, and the output of two or more lasers may be combined optically in a single beam. The elements may be heated uniformly during exposure to increase the sensitivity if desired.

Whichever scanning method is employed, the laser beam is focused to a spot (e.g., of about 5 to 30 mm, preferably 15–25 mm or 20 μm diameter) which is scanned relative to the surface of the elements while the laser output is modulated in accordance with image information. Two distinct modulation methods are suitable for imaging the elements. In the first, the laser operates at a fixed power level, but is switched on and off in accordance with the image information. This method is suited to the generation of high contrast (e.g., half tone) images. In the second, the laser power output is continuously variable, or variable over a sufficient number of discrete levels (e.g., 128 or 256 grey levels) to simulate continuous variability, and this is compatible with lower contrast, continuous tone imaging.

Depending on the exposure conditions (i.e., the laser power, the scan rate and the method of modulation), the image produced may or may not be immediately visible to the naked eye. For example, by suitable selection of laser power and scan rate, operating in binary mode, high contrast 'direct write' (printout) images may be produced, suitable for use as contact masks etc., without further processing. Alternatively, the initial image may be amplified by a uniform thermal processing step subsequent to laser exposure. This has the effect of increasing the Dmax available from a given exposure, and in many cases alters the image colour to a more neutral blue-black tone. Depending on the conditions used, thermal processing may alter the contrast of the final image. Thermal processing is particularly useful in the case of continuous tone imaging.

Any of the standard methods of thermal processing may be employed, such as heated platens, heated rollers, hot air blowing etc. Processing conditions may be optimised for individual cases, but generally involve heating at a temperature in the range 70°–130° C. for a brief period, e.g., in the range 1–60 seconds. For elements exposed to continuously-modulated laser exposure, processing under relatively mild conditions, such as about 10 seconds at 85° C., favours low-contrast, continuous tone images, whereas harsher conditions (longer development time and/or higher temperatures e.g., 20 seconds at 115° C.) gives a higher contrast. It is noteworthy that the aforementioned processing temperatures are typically lower than the Tg of the binder of the layer containing the silver salt. This degree of control over the image characteristics, by manipulation of the laser exposure and thermal processing conditions, is believed to be unique in the field of thermographic and photothermographic imaging.

Apart from the optional thermal processing described above, no further treatment is necessary to develop or fix the image, and the image may be put to the intended use immediately. For example, in medical imaging applications it may be inspected visually and used for diagnostic purposes; or in graphic arts applications it may be used as a contact mask for the flood exposure (e.g., in a vacuum printing frame) of a conventional photosensitive element such as a printing plate, colour proofing element or duplicating film. With regard to the latter end use, as an alternative to forming a separate mask (which must be assembled in contact with the conventional photosensitive element), it is possible to incorporate the imaging media of the invention in conventional photosensitive elements in a manner such that laser exposure generates an integral mask for subsequent flood exposure of the photosensitive element. The resulting imaging elements thus comprise two independent imaging media, namely an infrared sensitive medium in accordance with the present invention, and a conventional photosensitive medium, such as a photocuring or photosolubilising medium, which is typically sensitive to UV radiation. The two types of imaging media may be coated on the same side of a substrate (separated, if necessary, by a transparent barrier layer to isolate the one from the other), or on opposite sides of a transparent substrate. Our copending British Patent Application No. 9508031.3 discloses analogous imaging elements comprising a conventional UV-sensitive imaging medium and an IR-sensitive imaging medium capable of forming an integral mask. Although the mask-forming chemistry described therein differs from that of the present invention, the overall constructions and methods of use are entirely analogous.

The invention is hereinafter described in more detail by way of example only, with reference to the accompanying Figures showing plots of image density against laser power.

The following is an explanation of abbreviations, tradenames and structural formulae referred to in the Examples:

Butvar B76—poly(vinyl butyral) resin, supplied by Monsanto

CAB-381-20—cellulose acetate butyrate, supplied by Eastman Kodak

Scripset 640—styrene-maleic anhydride copolymer, supplied by Monsanto

Elvacite 2008—poly(methyl methacrylate), supplied by Du Pont

SDP—homopolymer of tetrahydropyran-2-yl methacrylate (WO92/09934)

CAO-5—2,2'-methylenebis(4-methyl-6-t-butylphenol)

FC surfactant—N-methylperfluorooctanesulphonamide

MEK—methyl ethyl ketone (butan-2-one)

OD—optical density

IR absorbing dyes:

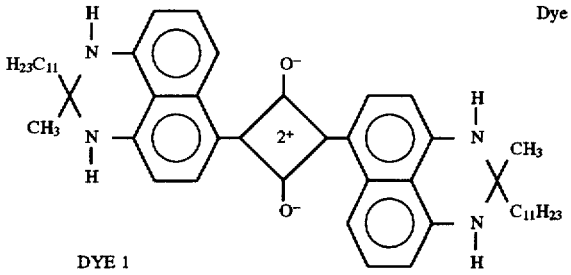

DYE 1

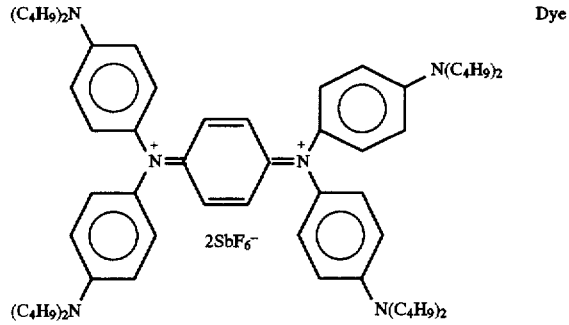

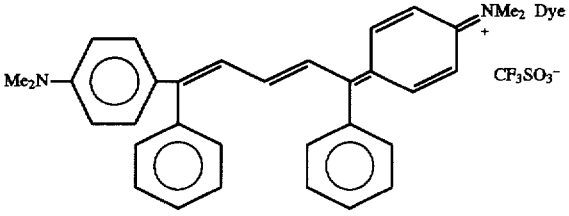

-continued

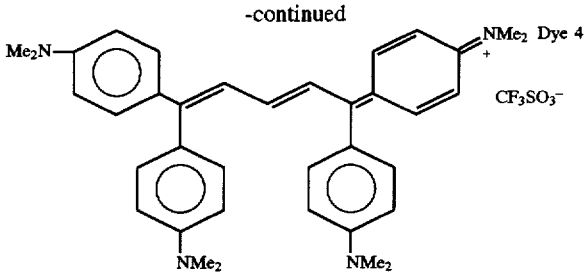

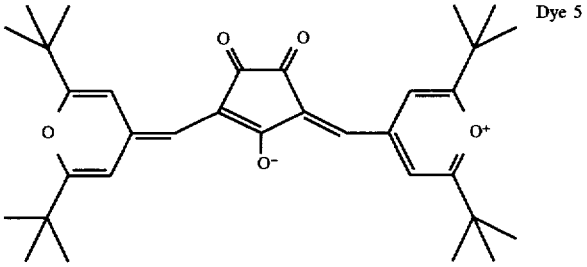

In the following examples, all coatings were made on 100 μm unsubbed polyester base using wire-wound bars. The ingredients for the first layer (silver behenate full soap, binder and other constituents as appropriate) were homogenised for at least 30 minutes prior to coating at 36 μm wet thickness. The first layer was dried thoroughly at 40° C. before coating the second layer at 12 μm wet thickness and drying at ambient temperature.

Unless indicated otherwise, laser exposures were carried out using an external drum scanner equipped with a laser diode delivering 116 mW at 830 nm at the image plane. Linear scans were performed at varying speeds in the range 100–1000 cm/sec, with the beam focused to a 20 μm spot.

EXAMPLE 1

This example demonstrates the effect of increasing binder Tg.

The following formulations were prepared and coated, varying the identity of the binder as indicated in Table 1:

| Layer 1 | | Layer 2 | |
|---|---|---|---|
| silver behenate - | 15.0 g | Dye 1 - | 0.05 g |
| (20 wt % in MEK/toluene 1:1) | | methyl gallate - | 0.15 g |
| phthalazinone - | 0.05 g | propyl gallate - | 0.15 g |
| binder - | 0.90 g | binder - | 0.025 g |
| MEK - | 7.50 g | MEK - | 6.0 g |

Samples were exposed at varying scan rates, then processed by placing in an oven at 85° C. for 5 seconds. Table 1 records the identity of the binders used, the relevant Tg values, a subjective assessment of the tone of the image formed, and the optical density developed at 420 nm for scan rates of 200, 400, and 600 cm/sec.

TABLE 1

| Binder | Tg* | Tone | 200 cm/sec | 400 cm/sec | 600 cm/sec |
|---|---|---|---|---|---|
| Butvar B-76(c) | 56 | brown | 2.7 | 1.2 | none |
| Elvacite 2008 | 118 | brown\black | 3.0 | 2.1 | 0.3 |
| CAB-381-20 | 128 | brown\black | 3.0 | 2.9 | 2.1 |

TABLE 1-continued

| Binder | Tg* | Tone | 200 cm/sec | 400 cm/sec | 600 cm/sec |
|---|---|---|---|---|---|
| SDP | 130 | brown\black | 3.6 | 2.6 | 0.6 |
| Scripset 640 | 148 | brown\black | 3.6 | 2.7 | 0.6 |

*- in °C., as determined using a Du Pont 2100 Thermal-Mechanical Analyser
(c)- comparative example, not in accordance with the invention.

The imaging elements of the invention showed clear improvements in one or more of Dmax, threshold sensitivity and image tone.

EXAMPLE 2

This example demonstrates the effect of toners in the presence of different binders. The following formulation was coated, varying the identity of the toner, dye and binder:

| Layer 1 | | Layer 2 | |
|---|---|---|---|
| silver behenate - | 15.0 g | dye - | 0.10 g |
| (20 wt % in MEK/toluene 1:1) | | methyl gallate - | 0.15 g |
| toner (if present) - | 0.05 g | propyl gallate - | 0.15 g |
| binder (solid) - | 0.9 g | binder (solid) - | 0.025 g |
| MEK - | 7.5 g | MEK - | 6.0 g |

The various samples were laser exposed at 200, 400 and 600 cm/sec, then processed at 80° C. for 5 seconds. (Samples comprising Dye 2 were exposed by a different laser source, delivering 150 mW at 987 nm at the image plane.)

Table 2 records the OD at 420 nm observed for the different scan speeds (after thermal processing) for the various combinations of toner, dye and binder and also the observed image tone.

TABLE 2

| IR Dye | Binder | Toner | OD200 | OD400 | OD600 | OD800 | Tone |
|---|---|---|---|---|---|---|---|
| Dye 1 | Butvar B-76(c) | none | 2.5 | 0.7 | — | — | brown |
| Dye 1 | Butvar B-76(c) | phthalazinone | 2.8 | 1.2 | 0.5 | — | brown |
| Dye 1 | Butvar B-76(c) | phthalazine | 2.4 | 0.7 | — | — | brown |
| Dye 1 | SDP | none | 3.6 | 0.9 | — | — | brown |
| Dye 1 | " | phthalazinone | 2.4 | 0.6 | — | — | black |
| Dye 1 | " | phthalazine | 2.9 | 0.8 | — | — | black |
| Dye 2 | SDP | none | >3.6 | 3.6 | 2.2 | 1.2 | brown |
| Dye 2 | " | phthalazinone | 6 | 3.6 | 2.4 | 1.2 | black |

(c) = control example, not in accordance with the invention

The results show that formulations in accordance with the invention gave a superior performance in terms of imaging speed and/or image tone. Although images were obtained from the formulations comprising Butvar-B76 as binder, these were brown in appearance, even when toners were used, and a relatively low Dmax was obtained.

EXAMPLE 3

This example demonstrates the use of a hindered bisphenol as reducing agent, and a variety of IR absorbing dyes. The following formulation was coated and tested as described in Example 1, varying the identity of the dye as shown in Table 3:

| Layer 1 | | Layer 2 | |
|---|---|---|---|
| silver behenate - | 2.0 g | dye - | 0.10 g |
| (10 wt % in MEK) | | CAO-5 - | 0.10 g |
| phthalazinone - | 0.1 g | SDP - | 0.50 g |
| SDP - | 1.0 g | (10 wt % in MEK) | |
| (20 wt % in MEK) | | | |
| benzhydrol - | 0.15 g | | |
| MEK - | 12.0 g | MEK - | 5.5 g |

Laser scans were made at various speeds, then the presence or absence of visible tracks was recorded before and after uniform heating for 10 seconds at 100° C. In all cases, yellowish direct-write images were observed for the slower scan speeds (100–200 cm/sec), which darkened on thermal processing. Also as a result of thermal processing, visible images developed to varying extents in the areas subjected to laser scanning at higher speeds.

Table 3 records the identities of the dyes used, the pre-exposure OD at 830 nm, and the maximum scan rate giving rise to a visible image after thermal processing.

TABLE 3

| | OD at 830 nm | Max. Scan Speed (cm/sec) |
|---|---|---|
| Dye 1 | 1.2 | 1000 |
| Dye 2 | 0.6 | 400 |
| Dye 3 | 1.2 | 1000 |
| Dye 4 | 1.2 | 400 |
| Dye 5 | 2.4 | 1000 |

EXAMPLE 4

This example demonstrates direct-write imaging, with optional thermal amplification. The following formulation was coated:

| Layer 1 | | Layer 2 | |
|---|---|---|---|
| silver behenate - | 6.0 g | Dye 1 - | 0.10 g |
| (10 wt % in MEK) | | methyl gallate - | 0.20 g |
| phthalazinone - | 0.10 g | SDP - | 0.50 g |
| benzhydrol - | 0.15 g | (20 wt % in MEK) | |
| SDP - | 3.0 g | MEK - | 5.5 g |
| (20 wt % in MEK) | | | |
| FC surfactant - | 0.05 g | | |
| MEK - | 6.0 g | | |

Laser exposure at a scan speed of 200 cm/sec produced a dense brown image (transmission OD 2.1 at 420 nm) on a clear background, suitable for use as a contact mask. Thermal processing (10 seconds at 85° C.) increased the Dmax to 3.0 and gave a darker tone, without affecting the Dmin.

EXAMPLE 5

This example demonstrates continuous tone imaging, and also the control of image contrast by variation of the relative quantities of silver salt and binder. Elements A and B were prepared from the following formulations:

| Layer 1 | | Layer 2 | |
|---|---|---|---|
| (A) | | | |
| silver behenate - (10 wt % in MEK) | 6.0 g | Dye 1 - | 0.10 g |
| | | methyl gallate - | 0.20 g |
| phthalazinone - | 0.10 g | SDP - (20 wt % in MEK) | 0.50 g |
| benzhydrol - | 0.15 g | | |
| SDP - (20 wt % in MEK) | 9.0 g | MEK - | 5.5 g |
| FC surfactant - | 0.05 g | | |
| (B) | | | |
| silver behenate - (20 wt % in MEK/toluene 1:1) | 15.0 g | Dye 1 - | 0.10 g |
| | | methyl gallate - | 0.15 g |
| phthalazinone - | 0.05 g | propyl gallate - | 0.15 g |
| benzhydrol - | 0.15 g | SDP (solid) - | 0.025 g |
| SDP (solid) - | 0.9 g | MEK - | 6.0 g |
| FC surfactant - | 0.05 g | | |

Both elements were given an additional clear topcoat of bisphenol-A polycarbonate (10 wt % solution in dichloromethane, coated at 12 μm wet thickness).

Element A had a silver coating weight of 0.57 g/m$^2$ and a binder silver salt weight ratio of 3:1, while for Element B the corresponding figures were 0.82 g/m$^2$ and 1:3.

Samples of each were laser scanned at 150 cm/sec, the laser power being varied continuously between 20 and 116 mW. Both elements gave brown direct-write images which darkened and intensified on thermal processing.

Figure 2:
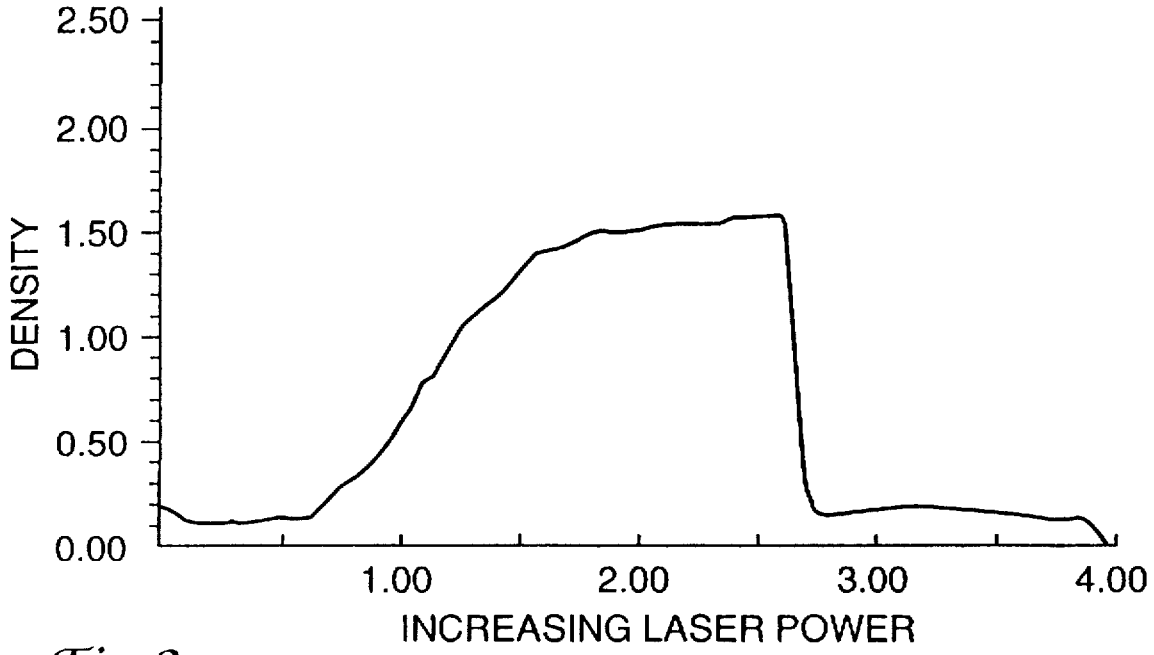

When samples of Element A were processed at 85° C. for 10 seconds, a continuous tone image was obtained, as evidenced by a plot of image density vs laser power (FIG. 1), which was linear over a wide range of laser power, with a relatively shallow slope. A similar plot for Element B (processed at 83° C. for 7 seconds) was also linear, but with a much steeper slope (FIG. 2).

Figure 3:
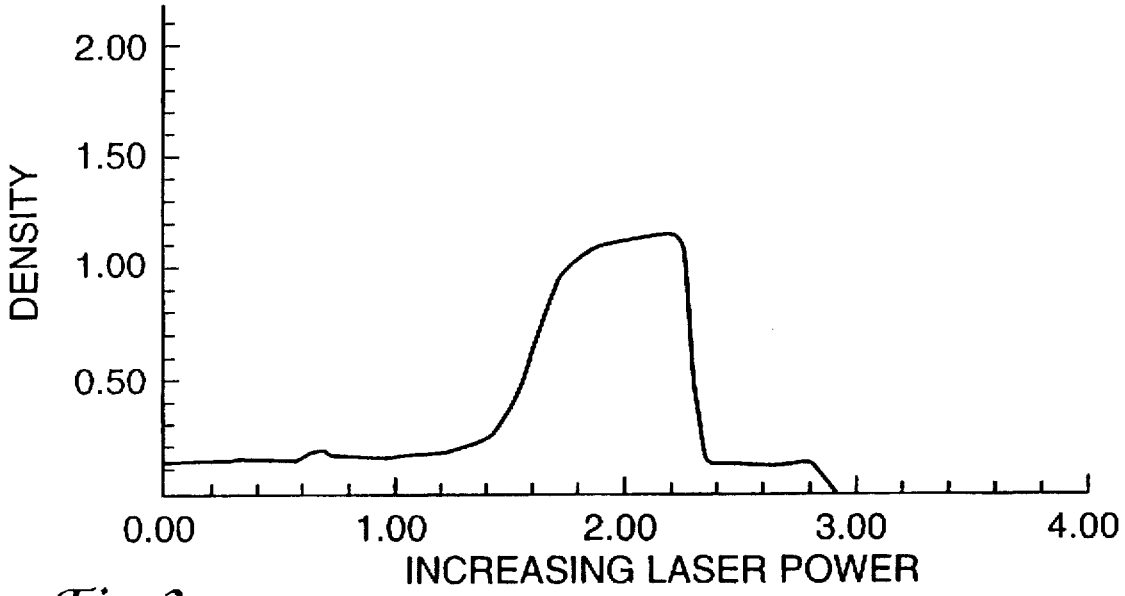

When samples of Element A were processed under harsher conditions (e.g., 95° C. for 10 seconds, or 85° C. for 30 seconds), the continuous tone capability was lost, and the essentially bilevel response shown in FIG. 3 was obtained.

When a formulation similar to that of Element A, but substituting Butvar B-76 for SDP as the binder, was coated and imaged in the same way, a continuous tone image was obtained, but with a brown image tone and low Dmax.

We claim:

1. An infrared laser addressable imaging element comprising a substrate bearing a first layer comprising a reducible light-insensitive silver salt and a binder; and a second layer comprising an infrared absorber, a reducing agent for said silver salt and a binder; wherein said binder of said first layer is a polymeric medium having a glass transition temperature of at least 80° C.

2. An imaging element according to claim 1 wherein said binder of said first layer is a polymeric medium having a glass transition temperature of at least 100° C.

3. An imaging element according to claim 2 wherein the binder of said first layer is a polymeric medium having a glass transition temperature of at least 120° C.

4. An imaging element according to claim 1 wherein said polymeric medium is selected from polyesters; polycarbonates; cellulose esters; polymers and copolymers of acrylic and methacrylic acids and ester, amide and nitrile derivatives thereof; and polymers and copolymers maleic anhydride and vinyl monomers.

5. An imaging element according to claim 4 wherein said polymeric medium is a member selected from the group consisting of polymers and copolymers of methacrylate esters, styrene-maleic anhydride copolymers and cellulose acetate butyrate and mixtures thereof.

6. An imaging element according to claim 1 wherein said polymeric medium is capable of at least partial decomposition when under laser exposure.

7. An imaging element according to claim 6 wherein said polymeric medium comprises a backbone linked to a plurality of pendant groups, said pendant groups being convertible to polar species under action of heat or acid, or both.

8. An imaging element according to claim 7 wherein said pendant groups are members selected from the group consisting of t-alkyl esters, benzyl esters, alkoxyalkyl esters and cyclic acetal esters.

9. An imaging element according to claim 8 wherein said pendant groups are cyclic acetal esters.

10. An imaging element according to claim 9 wherein said polymeric medium comprises a member selected from the group consisting of polymers and copolymers of tetrahydropyranyl methacrylate.

11. An imaging element according to claim 1 wherein said reducible light-insensitive silver salt comprises a silver salt of a long chain alkanoic acid containing 10 to 30 carbon atoms.

12. An imaging element according to claim 11 wherein said silver salt is silver behenate.

13. An imaging element according to claim 1 wherein said reducing agent is a member selected from the group consisting of esters of gallic acid, hindered phenols, polyhydroxybenzenes, ascorbic acid and 1,4-dihydropyridines.

14. An imaging element according to claim 12 wherein said reducing agent is a member selected from the group consisting of methyl gallate, propyl gallate, 2,2-methylenebis(4-methyl-6-t-butylphenol), and mixtures thereof.

15. An imaging element according to claim 1 wherein said infrared absorber strongly absorbs radiation in the range of 700 to 1200 nm, has minimal absorption in the range 380 to 700 nm and is a member selected from the group consisting of squarylium dyes, croconium dyes, amine cation radical dyes, and tetra-arylpolymethine dyes.

16. An imaging element according to claim 15 wherein said squarylium dyes have a nucleus of the following formula

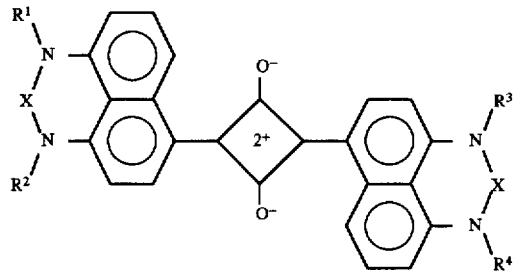

wherein $R^1$ to $R^4$ are independently members selected from the group consisting of hydrogen, alkyl, cycloalkyl, aralkyl, carboalkoxyalkyl and carboaryloxyalkyl group, X is a member selected from the group consisting of $>CR^5R^6$, $>POR^7$ and $>BOR^7$, wherein $R^5$ and $R^6$ are independently members selected from the group consisting of alkyl, cycloalkyl and aryl groups, or $R^5$ and $R^6$ together represents the necessary atoms to complete a 5, 6 or 7-membered ring, and $R^7$ represents an alkyl group.

17. An imaging element according to claim 1 wherein said first layer further comprises a toner which is a member selected from the group consisting of phthalazine and phthalazinone, and substituted derivatives thereof.

18. An imaging element according to claim 1 further comprising a separate photosensitive medium.

19. An imaging element according to claim 1 wherein said element is free of silver halide.

20. A method of imaging comprising the steps of:

1) an infrared laser addressable imaging element comprising a substrate bearing a first layer comprising a reducible light-insensitive silver salt and a binder; and a second layer comprising an infrared absorber, a reducing agent for said silver salt and a binder; wherein said binder of said first layer is a polymeric medium having a glass transition temperature of at least 80° C.

2) image-wise irradiating said element with infrared laser radiation of sufficient intensity so as to generate a latent image of silver specks having a $D_{max}$ of less than 1.0, and 3) heating said element to produce a visible image having a $D_{max}$ of at least 2.5.

21. A method according to claim 20 wherein said heating to produce a visible image does not raise the $D_{min}$ of background areas in said element by more than 0.2.

22. A method according to claim 20 wherein said heating is to a temperature which is lower than the glass transition temperature of said binder in said first layer.

23. A method according to claim 20 wherein said imaging element is uniformly heated during said exposure.

24. A method according to claim 20 wherein said laser is operated at a fixed power level and is switched on and off to generate said image wherein said method generates a half tone image.

25. A method according to claim 20 wherein said laser is operated at continuously variable power levels wherein said method generates a continuous tone image.

* * * * *